US012018434B2

(12) United States Patent
Rytkönen et al.

(10) Patent No.: US 12,018,434 B2
(45) Date of Patent: Jun. 25, 2024

(54) MULTILAYERED FIBROUS SHEET, A METHOD FOR MAKING A MULTILAYERED FIBROUS SHEET, AND USE OF MECHANICAL PULP

(71) Applicant: Metsä Board Oyj, Metsä (FI)

(72) Inventors: Ari Pekka Rytkönen, Äänekoski (FI); Esko Pekuri, Äänekoski (FI)

(73) Assignee: Metsä Board Oyj, Metsä (FI)

( * ) Notice: Subject to any disclaimer, the term of this patent is extended or adjusted under 35 U.S.C. 154(b) by 164 days.

(21) Appl. No.: 17/232,181

(22) Filed: Apr. 16, 2021

(65) Prior Publication Data

US 2021/0324582 A1 Oct. 21, 2021

(30) Foreign Application Priority Data

Apr. 16, 2020 (EP) ..... 20397505

(51) Int. Cl.

| | |
|---|---|
| ***D21H 11/10*** | (2006.01) |
| ***D21C 9/12*** | (2006.01) |
| ***D21H 11/02*** | (2006.01) |
| ***D21H 11/08*** | (2006.01) |

(52) U.S. Cl.

CPC ..... *D21H 11/10* (2013.01); *D21C 9/12* (2013.01); *D21H 11/02* (2013.01); *D21H 11/08* (2013.01)

(58) Field of Classification Search

CPC ..... D21H 11/10; D21H 11/02; D21H 11/08; D21H 27/10; D21H 27/03; D21C 9/12

See application file for complete search history.

(56) References Cited

U.S. PATENT DOCUMENTS

| | | | |
|---|---|---|---|
| 5,080,758 | A | 1/1992 | Horng |
| 5,916,417 | A | 6/1999 | Cassidy et al. |
| 2003/0168191 | A1 | 9/2003 | Hansen et al. |
| 2006/0102303 | A1 | 5/2006 | Lares |
| 2010/0024998 | A1 | 2/2010 | Wildlock et al. |

FOREIGN PATENT DOCUMENTS

| | | | | |
|---|---|---|---|---|
| CN | 104805737 | A | 7/2015 | |
| CN | 107268325 | A | 10/2017 | |
| CN | 109715882 | A | 5/2019 | |
| CN | 111101402 | A * | 5/2020 | ..... D21H 11/02 |
| EP | 2669432 | A1 | 12/2013 | |

(Continued)

OTHER PUBLICATIONS

Smook, Handbook for Pulp and Paper Technologists, 1992, Angus Wilde Publications, 2nd edition, chapters 4 and 16 (Year: 1992).*

(Continued)

*Primary Examiner* — Anthony Calandra
(74) *Attorney, Agent, or Firm* — Laine IP Oy

(57) ABSTRACT

According to an example aspect of the present invention, there is provided a multilayered fibrous sheet, such as paperboard, having a first layer comprising a first fibrous material, a second layer, spaced apart from the first layer, comprising a second fibrous material, and a third layer between the first and the second layers, comprising a third fibrous material, wherein at least one of the first and the second fibrous materials comprises or consists of a mixture of chemical pulp and mechanical pulp; and the third fibrous material comprises or consists of mechanical pulp.

27 Claims, 7 Drawing Sheets

(56) References Cited

FOREIGN PATENT DOCUMENTS

| | | | | | |
|---|---|---|---|---|---|
| JP | 2018084012 | A | * | 5/2018 | |
| WO | WO2006084883 | A1 | | 8/2006 | |
| WO | WO2008031921 | A1 | | 3/2008 | |
| WO | WO2013132021 | A1 | | 9/2013 | |
| WO | WO2014202841 | A1 | | 12/2014 | |
| WO | WO2015036930 | A1 | | 3/2015 | |
| WO | WO-2015041276 | A1 | * | 3/2015 | ..... D21H 11/08 |
| WO | WO2015087293 | A1 | | 6/2015 | |
| WO | WO2017006216 | A1 | | 1/2017 | |
| WO | WO2020003128 | A1 | | 1/2020 | |
| WO | WO2020003129 | A1 | | 1/2020 | |

OTHER PUBLICATIONS

Indriati et al., Mixed-Refining of BCTMP and LBKP for Lightweight Papers, 2019, Chemistry and Materials Research, vol. 11 No.8, p. 22-29. (Year: 2019).*

English Machine Translation from espacenet of CN 111101402 A, May 2020. (Year: 2020).*

* cited by examiner

MULTILAYERED FIBROUS SHEET, A METHOD FOR MAKING A MULTILAYERED FIBROUS SHEET, AND USE OF MECHANICAL PULP

FIELD

The invention relates generally to the field of paperboard manufacturing.

BACKGROUND

In paperboard manufacturing, particularly folding boxboard manufacturing, the bulk of the structure is an important property of the end product. An even more important goal is to increase the stiffness of the thin surface layers which contribute to the strength of the paperboard.

In the field of paperboard manufacturing, there is a need for developing a method for increasing the bulk of the paperboard while maintaining sufficient strength properties.

A further problem to be addressed is how to provide a broader selection of pulps that can serve as raw material.

There is also a need for decreasing fibre costs and energy costs in paperboard manufacturing.

Surprisingly, it has been found that at least a part of these problems can be solved by the present invention.

SUMMARY OF THE INVENTION

The invention is defined by the features of the independent claims. Some specific embodiments are defined in the dependent claims.

According to a first aspect of the present invention, there is provided a multilayered fibrous sheet, such as paperboard, having a first layer comprising a first fibrous material, a second layer, spaced apart from the first layer, comprising a second fibrous material, and a third layer between the first and the second layers, comprising a third fibrous material, wherein at least one of the first and the second fibrous materials comprises or consists of a mixture of chemical pulp and mechanical pulp; and the third fibrous material comprises or consists of mechanical pulp.

Various embodiments of the first aspect may comprise at least one feature from the following bulleted list:

- In said at least one of the first and second fibrous materials the proportion of mechanical pulp amounts to at least 5%, preferably 5 to 20%, for example 5 to 15%, by weight of said fibrous material.
- Both of the first and the second fibrous materials comprise or consist of a mixture of chemical pulp and mechanical pulp.
- In both of the first and second fibrous materials, the proportion of mechanical pulp amounts to at least 5%, preferably 5 to 20%, for example 5 to 15%, by weight of said fibrous material.
- The chemical pulp is bleached chemical pulp, in particular bleached kraft pulp, and comprises softwood, such as spruce or pine or mixtures thereof, or hardwood, such as birch, poplar, aspen, alder, maple, eucalypt tropical hardwood, or mixtures thereof, or it comprises or consists of a mixture of softwood and hardwood chemical pulp.
- The first and the second fibrous materials comprise softwood chemical pulp and hardwood chemical pulp in a ratio in the range 0/100 to 50/50, such as 5/95 to 30/70.

- The first and the second fibrous materials comprise softwood chemical pulp and hardwood chemical pulp in a ratio that is smaller than 30/70.
- Said softwood chemical pulp is bleached softwood chemical pulp and said hardwood chemical pulp is bleached hardwood chemical pulp.
- The mechanical pulp of said at least one of the first and the second fibrous materials comprises or consists of bleached chemi-thermomechanical pulp, produced from hardwood or softwood or combinations thereof, for example from birch or pine or a combination thereof
- The mechanical pulp of the third fibrous material is selected from the following: BCTMP, ground wood and combinations thereof
- The third fibrous material comprises a mixture of mechanical pulp and broke fibers.
- The third fibrous material comprises at least 70%, such as at least 85% mechanical pulp, by weight of said third fibrous material, or consists of mechanical pulp.
- The third fibrous material comprises less than 10%, such as less than 5% virgin chemical pulp, by weight of said third fibrous material.
- The sheet is a calendered paperboard.
- The sheet is folding boxboard.
- The sheet is folding boxboard and the geometrical SCT index of the folding boxboard is not greater than 21 Nm/g, for example not greater than 19 Nm/g.
- The first layer forms the front (in use) layer and the second layer forms the back (in use) layer of the sheet.
- The first layer contains bleached mechanical pulp, such as BCTMP, whereas the second layer is free from mechanical pulp.

According to a second aspect of the present invention, there is provided a method for making a multilayered fibrous sheet comprising a first layer comprising a first fibrous material, a second layer, spaced apart from the first layer, comprising a second fibrous material, and a third layer between the first and the second layers, comprising a third fibrous material; the method comprising the steps of: providing a first layer mixture comprising chemical pulp, for forming said first layer; providing a second layer mixture comprising chemical pulp, for forming said second layer; providing a third layer mixture comprising mechanical pulp, for forming said third layer; adding mechanical pulp to at least one of the first layer and second layer mixtures; forming the multilayered fibrous sheet by using said first, second and third layer mixtures for forming said first, second and third layers, respectively.

Various embodiments of the second aspect may comprise at least one feature from the following bulleted list:

- The method comprises adding bleached chemi-thermomechanical pulp to at least one of the first and second layer mixtures in an amount of at least 5% by weight of the fiber mass in said mixture.
- The method comprises refining of the first layer mixture and/or refining of the second layer mixture either after or before said adding of mechanical pulp.
- The mechanical pulp of said at least one of the first layer and second layer mixtures is BCTMP and said refining is carried out before adding the BCTMP.
- The method comprises steps of: adding softwood chemical pulp and hardwood chemical pulp in a ratio in the range of 0/100 to 30/70 to form the first layer mixture; adding softwood chemical pulp and hardwood chemical pulp in a ratio in the range of 30/70 to 50/50 to form the second layer mixture.

Said chemical pulp of the first layer mixture consists of hardwood chemical pulp.

The first layer mixture and the second layer mixture are refined at an energy consumption of more than 55 kWh/t.

According to a third aspect of the present invention, there is provided use of mechanical pulp in combination with chemical pulp for a fibrous material of a surface layer or surface layers of a multi-layered fibrous sheet, such as paperboard.

Various embodiments of the third aspect may comprise at least one feature from the following bulleted list:

The mechanical pulp is BCTMP, and the multi-layered fibrous sheet is folding boxboard.

The surface layer or the surface layers are the front layer and/or the back layer of folding boxboard, and in said surface layer the proportion of mechanical pulp amounts to at least 5% by weight of the total fiber mass in said surface layer.

The present invention provides considerable advantages. The bulk of the paperboard, particularly the bulk of surface layers, is increased without disturbing bending strength properties.

The present invention makes it possible to improve the stiffness of the paperboard.

The present invention is cost-effective and still capable of maintaining the binding strength within the layers at a high level.

The present invention makes it possible to decrease the energy costs related to drying of the pulp during the paperboard manufacturing process. The advantages of the invention are particularly apparent in the production of cartonboard or containerboard, such as folding boxboard or linerboard.

Some embodiments of the invention enable use of cheaper raw materials.

Next embodiments will be examined in more detail.

EMBODIMENTS

Definitions

Figure 1:
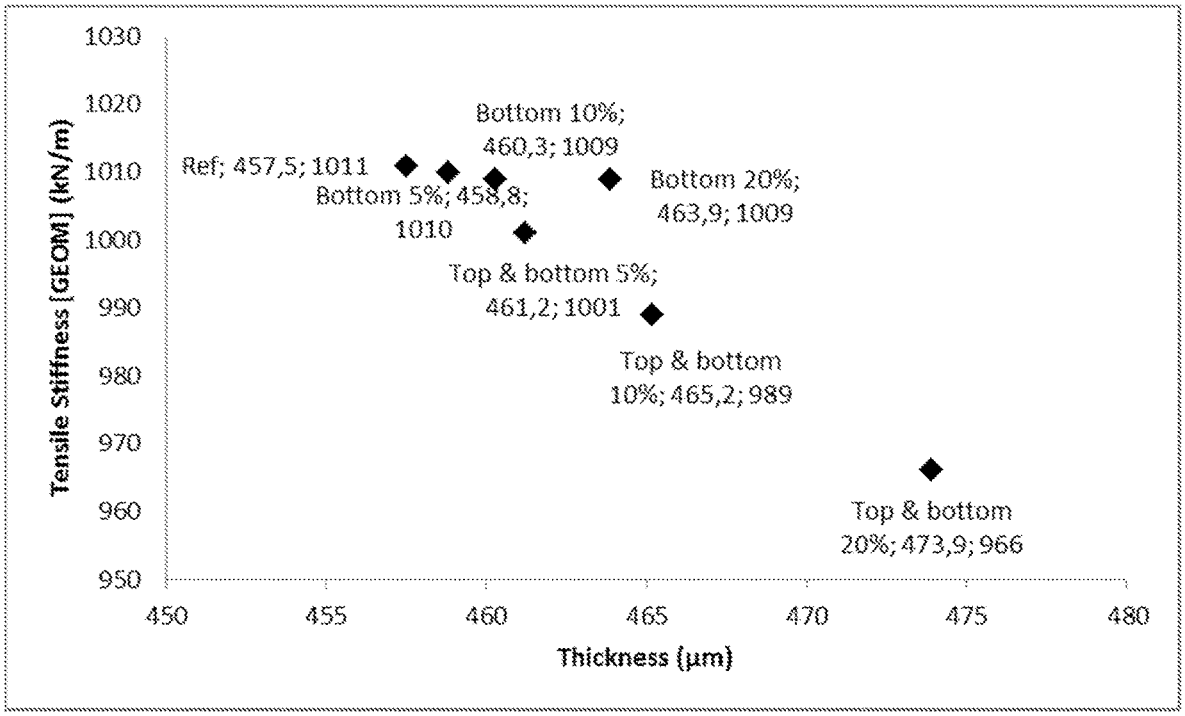
FIG. 1 shows a graph depicting tensile stiffness (GEOM) as a function of thickness for the structures prepared in Example 1.

In the present context, the term "paperboard" is to be understood to designate a fibrous web which can be used as such as a board, typically having a grammage in the range indicated below, or which can be used as a part of a board or a converted board. The board or converted board can be uncoated or coated.

"Grammage" indicates how many grams one square meter weighs. The grammage of paperboard is typically from 90 to 600 g/m$^2$.

"Bulk" expresses the specific volume of a material. Bulk is the inverse of density.

Geometric SCT index is measured according to ISO 9895 and is calculated as the square root of the product of the SCT index in machine direction and cross direction. SCT index describes the compression strength of the product.

By means of the present invention it is possible to produce paperboards having improved combined properties of bulk and strength compared to conventional paperboards.

Surprisingly, it has been observed that it is possible to improve the bending stiffness of the paperboard via increasing the bulk of the surface layers. In embodiments of the present method, the modulus of elasticity of the surface layers is not compromised.

The product according to the invention is a multilayered fibrous sheet, such as paperboard.

In one embodiment, the product according to the invention comprises a first layer comprising a first fibrous material, a second layer, spaced apart from the first layer, comprising a second fibrous material, and a third layer (middle layer) between the first and the second layers, comprising a third fibrous material.

In one embodiment, the first layer forms the front (top) layer and the second layer forms the back (bottom) layer of the sheet.

In preferred embodiments, at least one of the first and the second fibrous materials, or both, consists of a mixture of chemical pulp and mechanical pulp. Preferably said mechanical pulp is bleached mechanical pulp, such as BCTMP.

In preferred embodiments, the proportion of the mechanical pulp amounts to at least 5% by weight of said fibrous material. In one embodiment, the proportion of the mechanical pulp amounts to 20% or less, for example 5 to 15%, by weight of said fibrous material.

In some embodiments, the method for making a multilayered fibrous sheet comprises the steps of providing a front layer mixture comprising chemical pulp, providing a back layer mixture comprising chemical pulp, refining of the surface layer mixture and the back layer mixture, and adding mechanical pulp to at least one of the mixtures.

The front layer mixture to which mechanical pulp is to be added is preferably a mixture comprising softwood chemical pulp and hardwood chemical pulp in a ratio 5/95 to 30/70.

In one embodiment, the front layer mixture to which mechanical pulp is to be added is a mixture comprising softwood chemical pulp and hardwood chemical pulp in a ratio in the range 0/100 to 50/50, such as 5/95 to 30/70. Preferably the ratio is smaller than 30/70.

In one embodiment, the front layer mixture to which mechanical pulp is to be added consists of hardwood chemical pulp, preferably birch pulp. Hardwood pulp, particularly birch pulp, comprises short and stiff fibres which provide good light-scattering capability and opacity.

The front layer covers and preferably conceals the middle layer, which typically is darker in colour.

In some embodiments, the front layer comprises a porous structure to improve printability of the paperboard. Therefore, use of hardwood chemical pulp, particularly birch chemical pulp, in the front layer is advantageous.

The back layer mixture to which mechanical pulp is to be added is preferably a mixture comprising softwood chemical pulp and hardwood chemical pulp in a ratio in the range of 30/70 to 50/50. In the back layer, opacity or printability is typically not an important property. Therefore more softwood pulp may be used in the back layer. Additionally, the back layer is typically more light-weight than the front layer. By means of using larger amounts of softwood pulp, such as pine pulp, in the back layer, sufficient strength may be achieved.

In one embodiment, the back layer mixture to which mechanical pulp is to be added comprises more softwood pulp than the front layer mixture to which mechanical pulp is to be added. For example, the back layer mixture may comprise 30 to 50% softwood pulp, and the front layer mixture may comprise 0 to 30% softwood pulp.

It is advantageous to add mechanical pulp to the front layer mixture only, because optimization of strength is easier in that case. Further, the front layer is typically covered by a coating layer comprising pigments. Such a pigment coating effectively conceals the front layer. Therefore it is possible to add mechanical pulp, which is darker and coarser than chemical pulp, to the front layer.

In some embodiments, it is advantageous to add mechanical pulp to both the front layer mixture and to the back layer mixture in order to achieve larger cost savings. In this embodiment it is possible to optimize costs and the back layer thickness and to obtain either higher back layer thickness with similar cost level or alternatively reduced costs with the same back layer thickness.

In one embodiment, the first layer contains bleached mechanical pulp, such as BCTMP, whereas the second layer is free from bleached mechanical pulp.

In one embodiment the front layer mixture and the back layer mixture are both refined at an energy consumption of more than 55 kWh/t, such as more than 65 kWh/t. In one embodiment, the energy consumption in refining is less than 100 kWh/t.

In some embodiments, the front layer mixture and/or the back layer mixture are refined at an energy consumption of less than 100 kWh/t.

The chemical pulp in the first and second layers is preferably bleached chemical pulp, in particular bleached kraft pulp.

The chemical pulp in the first and second layers preferably comprises softwood, such as spruce or pine or mixtures thereof, or hardwood, such as birch, poplar, aspen, alder, maple, eucalypt tropical hardwood, or mixtures thereof, or it comprises a mixture of softwood and hardwood chemical pulp.

In some embodiments, the first and the second fibrous materials comprise 5 to 95 percent, in particular 10 to 90 percent, bleached hardwood chemical pulp and 95 to 5 percent, in particular 90 to 10 percent bleached softwood chemical pulp, calculated from the weight of the chemical pulp in respective material.

In some embodiments, the first fibrous material comprises 10 to 40 percent softwood chemical pulp and 60 to 90 percent hardwood chemical pulp, and the second fibrous material comprises 40 to 60 percent softwood chemical pulp and 60 to 40 percent hardwood chemical pulp, said percentages being calculated from the weight of the chemical pulp in respective material.

Preferably the first and optionally the second fibrous material contains up to 20%, for example 5 to 20% mechanical pulp, such as bleached mechanical pulp, by weight of said fibrous material.

The bleached mechanical pulp may be bleached chemithermomechanical pulp, produced from hardwood or softwood or combinations thereof, for example from birch or pine or a combination thereof.

Typically, the third fibrous material comprises mechanical pulp.

In some embodiments, the third fibrous material comprises broke. Preferably the third fibrous material comprises 10 to 30% broke. In one embodiment, at least 25% of the broke in the third fibrous material is chemical pulp.

The third fibrous material preferably comprises a mixture of mechanical pulp and broke fibers.

The use of broke in the third fibrous material is highly advantageous, because broke comprises additives and binders, which increases the strength of the paperboard end-product.

Examples of suitable types of broke include: trimming broke, machine reel change broke. Machine broke, which in uncoated, is preferred as it does not contain any pigment coating agents. Pigment coating agents are not capable of forming bonds with fibres.

Preferably, the mechanical pulp of the third fibrous material is selected from the following group: ground wood (GW), pressure ground wood (PGW), thermomechanical pulp (TMP), chemithermomechanical pulp (CTMP), bleached chemithermomechanical pulp (BCTMP), semi-chemical pulp, and combinations thereof.

Preferably, the mechanical pulp of the third fibrous material comprises or consists of ground wood (GW) and/or bleached chemithermomechanical pulp (BCTMP), most preferably BCTMP.

In some embodiments, the sheet is a calendered paper board.

In some embodiments, the sheet is folding box board.

In one embodiment, the Scott bond of the paperboard is at least 90 $J/m^2$.

In one embodiment, the bulk of the paperboard is at least 1.65 $cm^3/g$, for example at least 1.75 $cm^3/g$.

In one embodiment, the thickness of the paperboard is in the range of 350 to 650 μm.

In some embodiments, the thickness of each of the surface layers is at least 5% of the thickness of the multi-layered fibrous sheet in order to provide a sufficient modulus of elasticity in the end product.

In one embodiment, the grammage of the paperboard is in the range of 200 to 340 $g/m^2$.

In one embodiment, the paperboard is for use in or as a folding boxboard.

The present invention is capable of providing several advantages as described in the following.

Improvement of Scott Bond in combination with the bulk of the end product can be realized. Scott Bond and bulk are particularly important parameters in the characterization of folding boxboard.

The increase of bulk makes it possible to achieve the same level of bending stiffness in cross direction (CD) with a lighter board. The cross direction is typically the vertical direction. The compression strength of the end product can be increased.

The present invention provides a good balance in decreasing undesired delamination effects and in increasing bending stiffness.

By means of the present invention the distance between the surface layers can be increased.

By means of the present invention the amount of fibers and correspondingly the amount of bonds between the fibers is decreased in the surface layers and a more porous structure is obtained. A decrease of Scott Bond is advantageously avoided by increased refining of the surface layer mixtures.

Mechanical pulp (BCTMP) is typically darker (more yellowish) than chemical pulp. However, we have observed that the product of the present invention is capable of maintaining its brightness despite the addition of mechanical pulp, because light scattering increases due to the presence of fines of the mechanical pulp.

Example 1

In the experiments, the amount of BCTMP added to the surface layers was varied from 0 to 20%. BCTMP was added either only to the top layer, or alternatively to both the top layer and the bottom layer. The characteristics of the BCTMP are given in Table 1. The applied refining power values are shown in Table 2.

TABLE 1

Characteristics of BCTMP.

| | Standard | | Target | Min/ Max |
|---|---|---|---|---|
| Raw materials | | hardwood | 60 to 90 | |
| | | softwood | 10 to 40 | |
| CSF | ISO 5267-2 | ml | 300 | ±30 |
| Brightness 457 nm | ISO 2470 | % ISO | 82 | ±5 |
| Shive content | "Pulmac (0.1 mm)" | % | <0.3 | |
| Tensile index | ISO 5270/1924-2 | | 38 | |

TABLE 2

Refining power values.

| Sample | Refining, top layer (kWh/t) | Refining, bottom layer (kWh/t) |
|---|---|---|
| Reference (BCTMP 0%) | 61 | 48 |
| BCTMP 5% in bottom layer | 61 | 57 |
| BCTMP 10% in bottom layer | 61 | 70 |
| BCTMP 20% in bottom layer | 61 | 70 |
| BCTMP 5% in top and bottom layers | 70 | 57 |
| BCTMP 10% in top and bottom layers | 70 | 70 |
| BCTMP 20% in top and bottom layers | 70 | 70 |

FIG. 1 shows a graph depicting tensile stiffness (GEOM) as a function of thickness for the structures prepared in Example 1. Refining of the chemical pulp was slightly increased when incorporating BCTMP.

Weaker bonding can be compensated effectively in this way, even though the thickness of the product slightly increases. The BCTMP addition affects the tensile stiffness of the top layer to a larger extent than that of the bottom layer.

Figure 2:
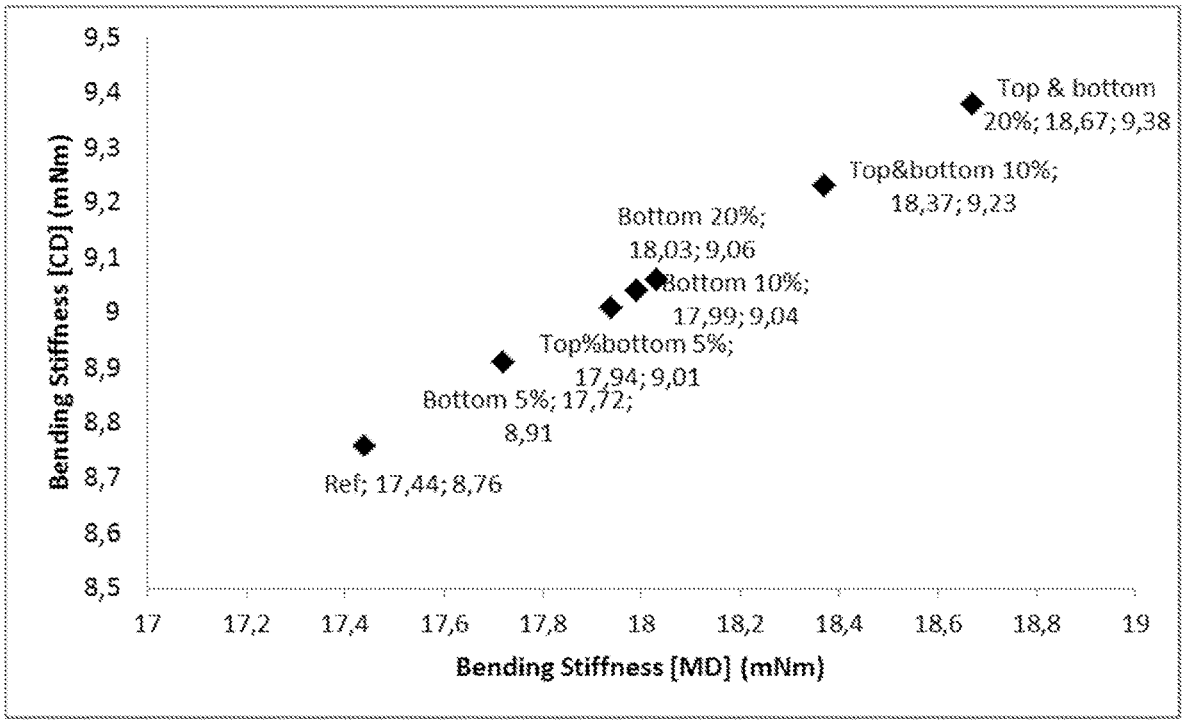
FIG. 2 shows a graph depicting bending stiffness (CD) as a function of bending stiffness (MD) for the structures prepared in Example 1.

FIG. 2 shows a graph depicting bending stiffness (CD) as a function of bending stiffness (MD) for the structures prepared in Example 1. It was observed that incorporation of BCTMP in combination with slightly increased refining improves the bending stiffness of the end product as a result of increased bulk and increased refining of the surface layers.

Figure 3:
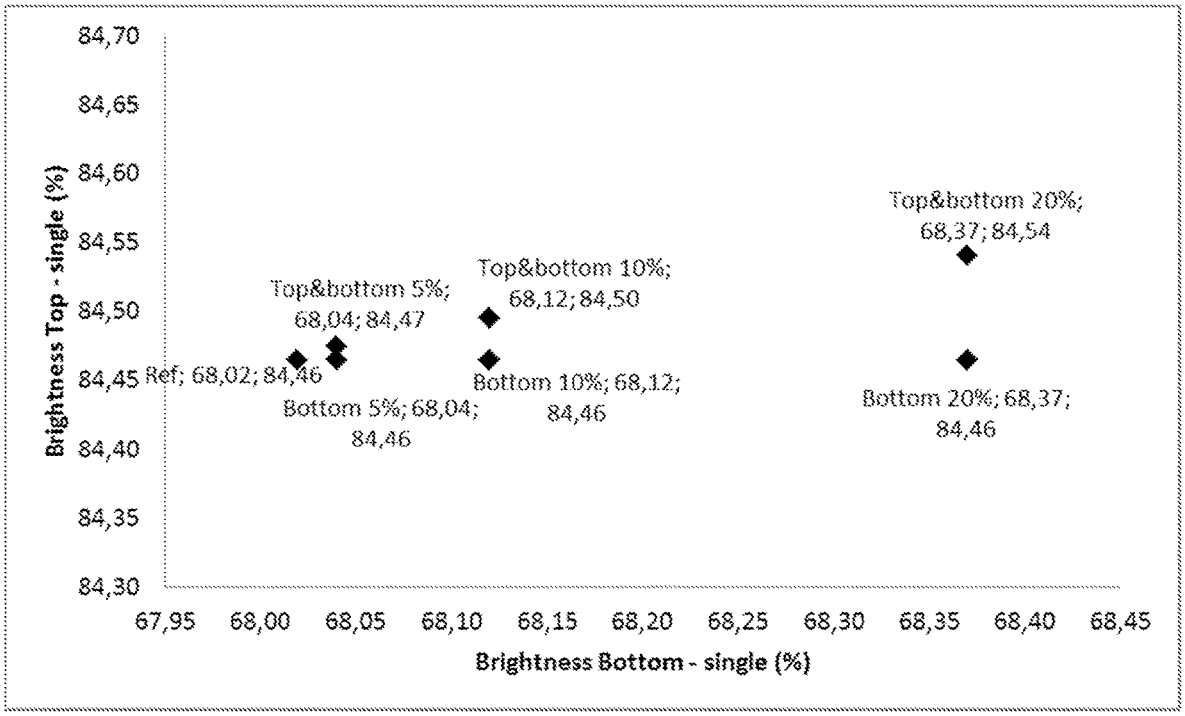
FIG. 3 shows a graph depicting brightness of the top layer as a function of brightness of the bottom layer, as measured for a single sheet, for the structures prepared in Example 1.

FIG. 3 shows a graph depicting brightness of the top layer as a function of brightness of the bottom layer, as measured for a single sheet, for the structures prepared in Example 1. The use of BCTMP in the surface layers has only small effects on the brightness of the product. Even though the brightness of BCTMP is lower than that of refined chemical pulp, the higher light scattering property of BCTMP compensates this. Thus, the darker middle layer can be covered more effectively.

Figure 4:
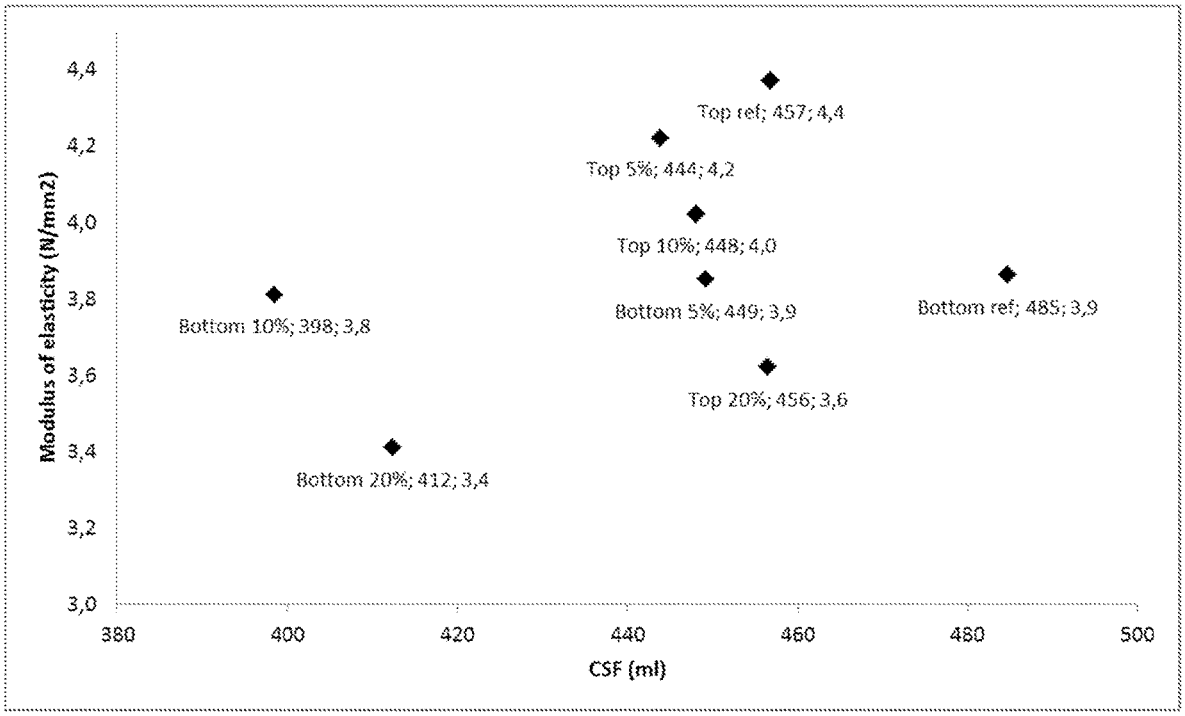
FIG. 4 shows a graph depicting modulus of elasticity as a function of CSF for the structures prepared in Example 1.

FIG. 4 shows a graph depicting modulus of elasticity as a function of CSF for the structures prepared in Example 1. CSF targets need to be relieved to some extent when increasing refining of the pulp. In these experiments, similar refining (specific energy consumption 70 kWh/t) was applied to the structures comprising 10% and 20% BCTMP, which is reflected in the results.

Figure 5:
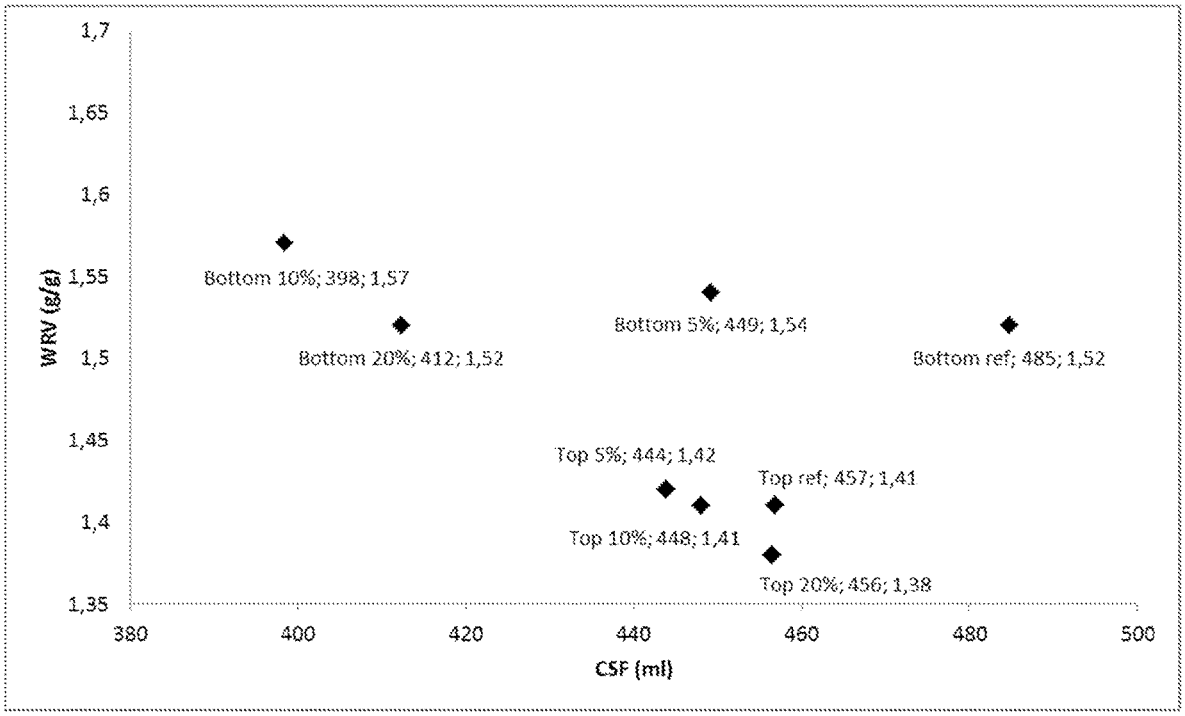
FIG. 5 shows a graph depicting WRV as a function of CSF for the structures prepared in Example 1.

FIG. 5 shows a graph depicting WRV (Water Retention Value) as a function of CSF (Canadian Standard Freeness) for the structures prepared in Example 1. When refining is increased, the water retention value (WRV) of the chemical pulp layers (surface layers) increases.

Figure 6:
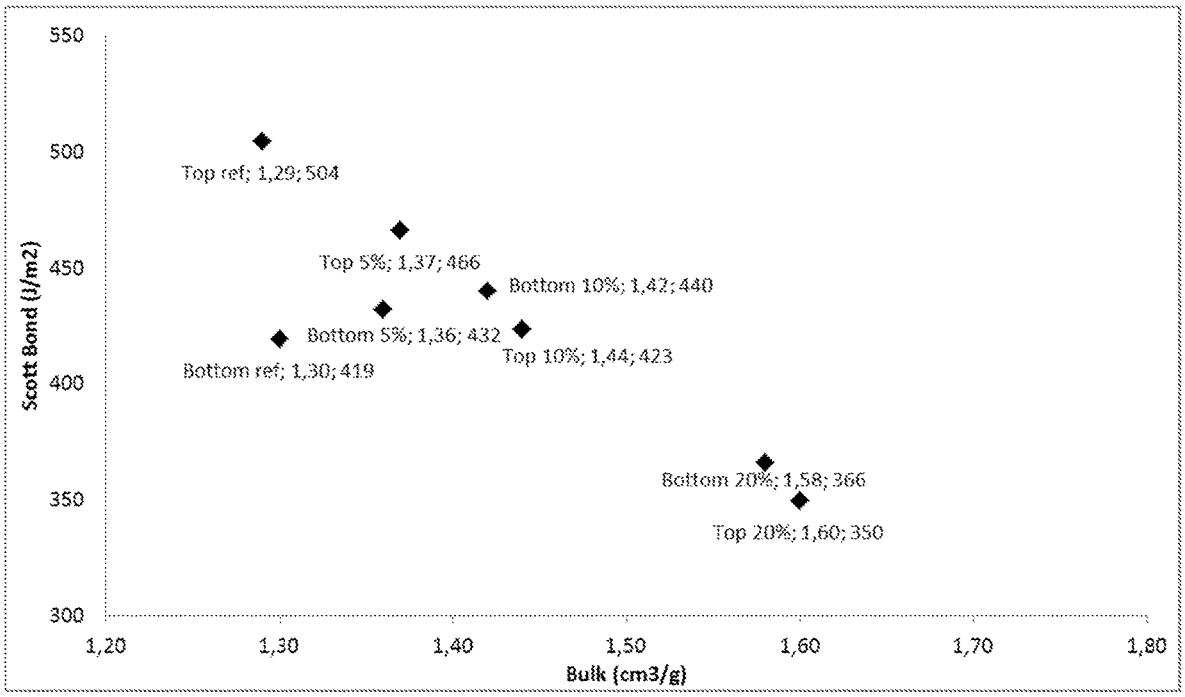
FIG. 6 shows a graph depicting Scott Bond as a function of bulk for the structures prepared in Example 1.

FIG. 6 shows a graph depicting Scott Bond as a function of bulk for the structures prepared in Example 1. In principle the incorporation of BCTMP might weaken the bonding between fibers (Scott Bond). However, it was observed that a sufficiently high Scott Bond level can be maintained by slightly increasing refining of the fiber mass. Optimization of the amount of BCTMP in the surface layers in relation to the extent of refining provides a good bulk level.

Figure 7:
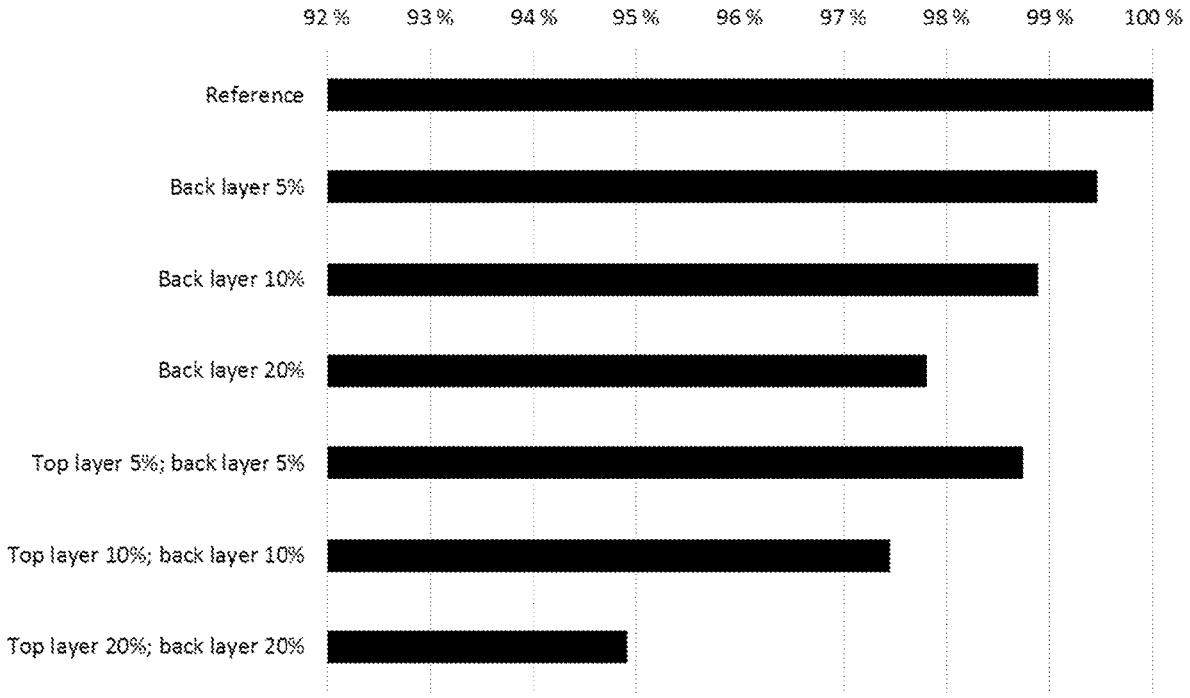
FIG. 7 shows graphically the cost of fiber mass, filler and refining energy incurred during manufacturing of the structures prepared in Example 1.

FIG. 7 shows graphically the relative cost of fiber mass incurred during manufacturing of the structures prepared in Example 1.

It can be concluded that by incorporating BCTMP in the surface layers the fiber costs decreased significantly.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

INDUSTRIAL APPLICABILITY

The present invention is industrially applicable at least in manufacturing of multilayered paperboard structures.

Acronyms List

BCTMP bleached chemithermomechanical pulp
GW ground wood
SW softwood
HW hardwood
MD machine direction
CD cross direction
CSF Canadian Standard Freeness
WRV Water Retention Value

The invention claimed is:

1. A multilayered fibrous sheet comprising:

a first layer comprising a first fibrous material, wherein the first fibrous material comprises at least chemical pulp, a second layer, spaced apart from the first layer, comprising a second fibrous material, wherein the second fibrous material comprises at least chemical pulp, and a third layer between the first and the second layers, comprising a third fibrous material, wherein:

at least one of the first and the second fibrous materials comprises a mixture of chemical pulp and mechanical pulp, wherein the mechanical pulp of the at least one of the first and the second fibrous materials is bleached chemi-thermomechanical pulp (BCTMP), and wherein the amount of the BCTMP in the at least one of the first and the second fibrous materials is at least 15% by weight, the third fibrous material comprises mechanical pulp, and wherein the multilayered fibrous sheet is folding boxboard.

2. The multilayered fibrous sheet according to claim 1, wherein, in at least one of the first and second fibrous materials, the amount of BCTMP is at least 20% by weight of said fibrous material.

3. The multilayered fibrous sheet according to claim 1, wherein:

both of the first and the second fibrous materials comprise a mixture of chemical pulp and BCTMP, and in both of the first and second fibrous materials, the amount of BCTMP is at least 15% by weight of said fibrous material.

4. The multilayered fibrous sheet according to claim 3, wherein, in said at least one of the first and second fibrous materials, the amount of BCTMP is 15 to 20% by weight of said fibrous material.

5. The multilayered fibrous sheet according to claim 3, wherein, in each of the first and second fibrous materials, the amount of BCTMP is in the range of from 15 to 20% by weight of the fibrous material.

6. The multilayered fibrous sheet according to claim 1, wherein the chemical pulp is bleached chemical pulp, and comprises softwood, hardwood, or mixtures thereof.

7. The multilayered fibrous sheet according to claim 6, wherein the first and the second fibrous materials comprise softwood chemical pulp and hardwood chemical pulp in a ratio in the range of 0/100 to 50/50 by weight.

8. The multilayered fibrous sheet according to claim 7, wherein the first and the second fibrous materials comprise softwood chemical pulp and hardwood chemical pulp in a ratio in the range of 5/95 to 30/70 by weight.

9. The multilayered fibrous sheet according to claim 1, wherein the first and the second fibrous materials comprise softwood chemical pulp and hardwood chemical pulp in a ratio less than 30/70 by weight, and wherein said softwood chemical pulp is bleached softwood chemical pulp and said hardwood chemical pulp is bleached hardwood chemical pulp.

10. The multilayered fibrous sheet according to claim 1, wherein the BCTMP of said at least one of the first and the second fibrous materials is produced from hardwood, softwood, or combinations thereof.

11. The multilayered fibrous sheet according to claim 1, wherein the mechanical pulp of the third fibrous material is selected from the group consisting of bleached chemi-thermomechanical pulp (BCTMP), ground wood, and combinations thereof.

12. The multilayered fibrous sheet according to claim 1, wherein the third fibrous material comprises a mixture of mechanical pulp and broke fibers.

13. The multilayered fibrous sheet according to claim 1, wherein the third fibrous material comprises at least 70% mechanical pulp, by weight of said third fibrous material.

14. The multilayered fibrous sheet according to claim 13, wherein the third fibrous material consists of mechanical pulp.

15. The multilayered fibrous sheet according to claim 1, wherein the third fibrous material comprises less than 10% virgin chemical pulp, by weight of said third fibrous material.

16. The multilayered fibrous sheet according to claim 1, wherein the geometrical SCT index of the folding boxboard is not greater than 21 Nm/g.

17. The multilayered fibrous sheet according to claim 1, wherein the first layer forms a front layer and the second layer forms a back layer of the sheet, wherein the first layer comprises the bleached chemi-thermomechanical pulp (BCTMP), and wherein the second layer is free from BCTMP.

18. The multilayered fibrous sheet of claim 1, wherein at least one of the first and second layers comprising a mixture of BCTMP and chemical pulp comprises a surface layer of the sheet.

19. The multilayered fibrous sheet according to claim 18, wherein the surface layer comprises the front layer and/or the back layer of the folding boxboard.

20. The multilayered fibrous sheet according to claim 1, wherein both of the first and the second fibrous materials comprise BCTMP, and wherein, in at least one of the first and the second layer fibrous materials, the proportion of BCTMP amounts to at least 20% by weight of said fibrous material.

21. The multilayered fibrous sheet according to claim 1, wherein the at least one of the first and the second fibrous materials has been refined after or before addition of the BCTMP.

22. A method for making a multilayered fibrous sheet comprising a first layer comprising a first fibrous material, a second layer, spaced apart from the first layer, comprising a second fibrous material, and a third layer between the first and the second layers, comprising a third fibrous material;

the method comprising the steps of:

providing a first layer mixture comprising chemical pulp, for forming said first layer;

providing a second layer mixture comprising chemical pulp, for forming said second layer;

providing a third layer mixture comprising mechanical pulp, for forming said third layer;

adding mechanical pulp to at least one of the first layer and second layer mixtures, wherein the added mechanical pulp to at least one of the first layer and second layer mixtures is bleached chemi-thermomechanical pulp (BCTMP), and wherein the amount of the BCTMP in the at least one of the first and the second fibrous materials is at least 15% by weight; and forming the multilayered fibrous sheet by using said first, second and third layer mixtures for forming said first, second and third layers, respectively, wherein the multilayered fibrous sheet is folding boxboard.

23. The method according to claim 22, further comprising adding bleached chemi-thermomechanical pulp to each of the first and second layer mixtures in an amount of at least 15% by weight of the fiber mass in said mixture.

24. The method according to claim 22, further comprising refining of the first layer mixture and/or refining of the second layer mixture either after or before said adding of BCTMP.

25. The method according to claim 24, wherein each of the first layer mixture and the second layer mixture comprises BCTMP, and wherein said refining is carried out before adding the BCTMP.

26. The method according to claim 22, further comprising the steps of:

adding softwood chemical pulp and hardwood chemical pulp in a ratio in the range of 0/100 to 30/70 by weight to form the first layer mixture, and adding softwood chemical pulp and hardwood chemical pulp in a ratio in the range of 30/70 to 50/50 by weight to form the second layer mixture.

27. The method according to claim 22, wherein said chemical pulp of the first layer mixture consists of hardwood chemical pulp.

* * * * *